US008096361B2

(12) United States Patent
Willberg

(10) Patent No.: US 8,096,361 B2
(45) Date of Patent: Jan. 17, 2012

(54) STIMULATED OIL PRODUCTION USING REACTIVE FLUIDS

(75) Inventor: Dean Willberg, Tucson, AZ (US)

(73) Assignee: Schlumberger Technology Corporation, Sugar Land, TX (US)

( * ) Notice: Subject to any disclaimer, the term of this patent is extended or adjusted under 35 U.S.C. 154(b) by 176 days.

(21) Appl. No.: 12/520,905

(22) PCT Filed: Dec. 29, 2006

(86) PCT No.: PCT/IB2006/004223

§ 371 (c)(1), (2), (4) Date: Nov. 2, 2009

(87) PCT Pub. No.: WO2008/081221

PCT Pub. Date: Jul. 10, 2008

(65) Prior Publication Data

US 2010/0059227 A1 Mar. 11, 2010

(51) Int. Cl.
*E21B 43/26* (2006.01)

(52) U.S. Cl. ..... 166/308.1; 166/250.12; 166/279; 166/300; 166/402

(58) Field of Classification Search ..... None
See application file for complete search history.

(56) References Cited

U.S. PATENT DOCUMENTS 4,484,630 A 11/1984 Chung
2007/0267191 A1 * 11/2007 Pfeiffer et al. ..... 166/252.5

FOREIGN PATENT DOCUMENTS

CA 1246994 12/1988
CA 2039919 10/1992

* cited by examiner

*Primary Examiner* — Zakiya W Bates
(74) *Attorney, Agent, or Firm* — Jeremy Tillman; David Cate; Robin Nava

(57) ABSTRACT

A method of stimulating production from a subterranean formation penetrated by a wellbore, comprising pumping a fluid from the well into the formation so as to create a hydraulic fracture. The fluid contains one or more reactive species that destabilize cohesive forces in the formation matrix. The method allows the fluid to leak of into the formation and react with the formation matrix so as to produce a destabilized zone in the formation around the location of the fracture such the formation fluids and sand particles can be produced from the formation through the zone and into the well.

19 Claims, 2 Drawing Sheets

STIMULATED OIL PRODUCTION USING REACTIVE FLUIDS

TECHNICAL FIELD

This invention relates to methods for stimulating oil production from well by pumping reactive stimulation fluids from the well into the formation. The methods are particularly relevant to cold heavy oil production.

BACKGROUND

The statements in this section merely provide background information related to the present disclosure and may not constitute prior art.

Cold heavy oil production with sand (CHOPS) is one of the many methods currently employed to extract viscous heavy oil from deposits in Canada. Not all fields or local reservoirs are amenable to this technique, but due to its low cost it is often the method of choice whenever it can be applied.

CHOPS is a well documented technique and is a standard method of producing heavy oil in Northern Alberta and Saskatchewan. Further details of this technique can be found in http://www.energy.gov.ab.ca/docs/oilsands/pdfs/RPT_Chops_chptr3.pdf. It includes the deliberate initiation of sand influx during the completion procedure, maintenance of sand influx during the productive life of the well, separation of the sand from the oil, and finally the disposal of the sand. No sand exclusion devices (screens, liners, gravel packs, etc.) are used in the wellbores, and no filters, cyclones or high pressure separators are used at the surface. The sand is produced along with oil water and gas, and separated from the oil by settling before being cleaned and sent to a facility for upgrading to a synthetic crude.

One stimulation treatment routinely performed on oil and gas wells in low-permeability reservoirs is hydraulic fracturing. Specially engineered fluids are pumped at high pressure and rate into the reservoir interval to be treated, causing a vertical fracture to open. The wings of the fracture extend away from the wellbore in opposing directions according to the natural stresses within the formation. Proppant, such as grains of sand of a particular size, can be mixed with the treatment fluid keep the fracture open when the treatment is complete. Hydraulic fracturing creates high-conductivity communication with a large area of formation and bypasses any damage that may exist in the near-wellbore area.

Fracture acidizing (sometimes called 'acid frac') is a variation on the hydraulic fracturing well-stimulation operation in which acid, usually hydrochloric [HCl], is injected into a carbonate formation at a pressure above the formation-fracturing pressure. Flowing acid tends to etch the fracture faces in a non-uniform pattern, forming conductive channels that remain open without a propping agent after the fracture closes. The length of the etched fracture limits the effectiveness of an acid-fracture treatment. The fracture length depends on acid leakoff and acid spending. If acid fluid-loss characteristics are poor, excessive leakoff will terminate fracture extension. Similarly, if the acid spends too rapidly, the etched portion of the fracture will be too short. The major problem in fracture acidizing is the development of wormholes in the fracture face; these wormholes increase the reactive surface area and cause excessive leakoff and rapid spending of the acid. To some extent, this problem can be overcome by using inert fluid-loss additives to bridge wormholes or by using viscosified acids. Fracture acidizing is also called acid fracturing or acid-fracture treatment.

Reactive chemical systems have been considered for stimulating the diatomite formations in California (note that these are not produced by CHOPS).

It is an object of the invention to provide a technique for improving oil recovery that can be used in heavy oil formations without some or all of the problems of the previous techniques.

SUMMARY

This invention provides methods of stimulating production from a formation surrounding a well, comprising:

pumping a fluid from the well into the formation so as to create a hydraulic fracture, wherein the fluid contains one or more reactive species that destabilise cohesive forces in the formation matrix; and allowing the fluid to leak of into the formation and react with the formation matrix so as to produce a destabilised zone in the formation around the location of the fracture such that formation fluids and sand particles can be produced from the formation through the zone and into the well.

The methods preferably comprise selecting the fluid so as to produce an at least partially unconsolidated formation matrix in the destabilised zone.

It is particularly preferred to produce fluids from the formation so as to cause worm-holing in the destabilised zone.

The fluid can contain additives in liquid form, solid or granular form. It is also preferred that the fluid acts as a diluent for heavy oil and can also modify formation fluid rheology.

One embodiment of the invention comprises alternately pumping the fluid containing the reactive species and a diverting fluid into the formation. Another comprises alternately pumping into the formation the fluid containing the reactive species and a fluid that acts to provide local consolidation in the matrix.

A method according to the invention can also comprise periodically injecting $CO_2$ into the formation and shutting in the well to allow the $CO_2$ to dissipate and dissolve followed by production from the formation.

Chemical, isotopic or radioactive tracers can be provided in the fluid.

Methods according to the invention have particular uses in wells producing heavy oil from the formation.

DETAILED DESCRIPTION OF SOME EMBODIMENTS

Figure 1:
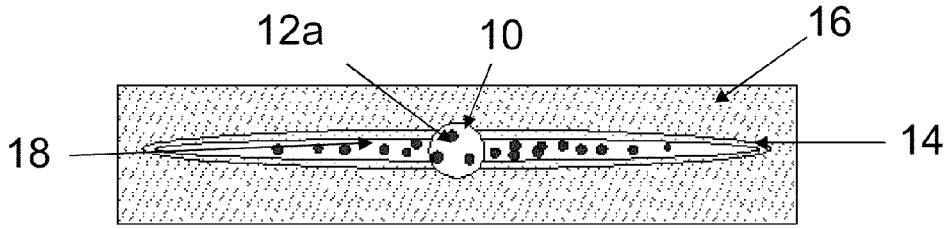
FIGS. 1-3 show a top view of a borehole at various stages of a procedure according to a first embodiment of the invention.

At the outset, it should be noted that in the development of any such actual embodiment, numerous implementation—specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary and this detailed description, each numerical value should be read once as modified by the term "about" (unless already expressly so modified), and then read again as not so modified unless otherwise indicated in context. Also, in the summary and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific, it is to be understood that inventors appreciate and understand that any and all data points within the range are to be considered to have been specified, and that inventors possessed knowledge of the entire range and all points within the range.

It has been extensively documented that many heavy oil formations produce more oil when sand is also produced. This observation has led to the extensive deployment of the CHOPS method in the heavy oil fields of Alberta and Saskatchewan. A goal of this invention is to stimulate a CHOPS-like process by a process of pumping a reactive chemical system in a similar fashion to an acid frac. The objective, however, is not to create an etched-face fracture as in acid frac, but to create a lens of "destabilized" rock extending a distance from the well bore. The reactive chemicals can destabilize the rock matrix, facilitating production of sand and oil in the leakoff zone surrounding the fractured region. High permeability channels can develop in the lens as the oil is produced, essentially opening more communication possibilities from the formation up to the wellbore.

The invention is similar to acid fracturing in that a hydraulic fracture is created using a reactive liquid (the process of acid fracturing is broadly described above). However, in the case of this invention, an open channel or fracture after the treatment is completed is not intended. In fact it does not particularly matter if the fracture is completely healed after the treatment is completed and the formation closes. Rather, this invention creates a lens of destabilized rock matrix surrounding the "ghost" of the hydraulic fracture. This rock will have a higher propensity to failure and worm holing than the native rock in the formation. Production such as CHOPS can therefore be stimulated in this region.

There are a number of chemical systems that can be used as the reactive liquid, depending on the rock type and other operational parameters. Examples include:

Strong bases such as sodium hydroxide (NaOH). These have previously been used to dissolve silicates, and can be used in this invention to destabilize the cementation between particles.

Delayed systems such as magnesium oxide (MgO), solid NaOH pellets, or alkaline glasses can be left in the fracture and allowed to react after pumping has finished.

Simple mineral acids can be used to destabilize rock when the cementatious materials are of a carbonate nature and are prone to acid dissolution.

Hydrofluoric acid and mud acid can be used to destabilize sandstones, clays and other silicate and aluminosilicate cementatious materials.

Hydrofluoric acid precursors such as ammonium bifluoride can be pumped with acid precursors such as esters, polylactic acid, sodium bisulfate, etc.

Various types of organic chelating agents (EDTA's, etc.).

If the cementatious materials are clays, then some simple brines (NaCl,) fresh water, or simple surfactants may destabilize the rock.

The fluid system are designed to have the correct rheology and leakoff characteristics in order for it to be pumpable, and for it to place the reactive materials sufficiently far from the wellbore. The basic techniques for this are essentially the same as are used in other fracturing operations.

Figure 2:
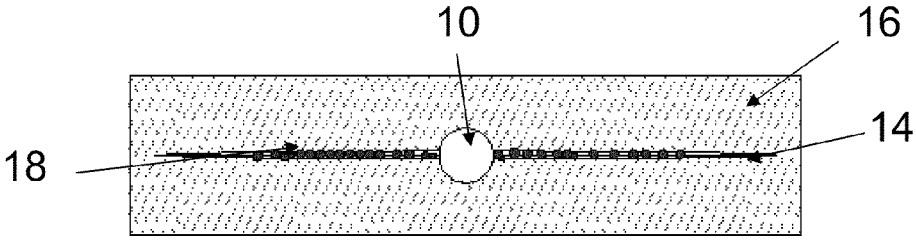
Figure 3:
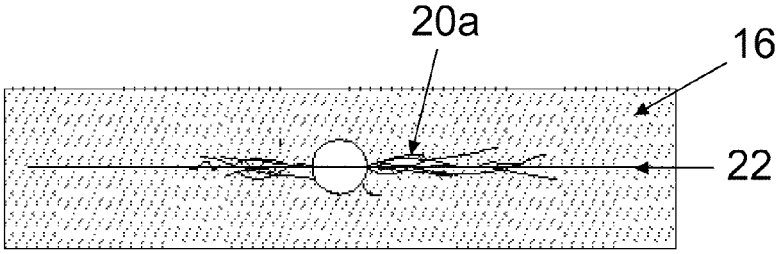

By adjusting the leakoff characteristics of the fluid, the total volume pumped, and the chemical nature of the reactive additive (liquid, solid, etc.) the width and length of the region affected can be controlled. Tuning this method allows subsequent worm holing to be directed and optimized for a given formation. For example, by including solid state reactive materials the destabilized rock would tend to be located primarily in a narrow region occupied by the ghost (re-healed) fracture. FIG. 1 shows an axial view of a borehole 10 which has been pressurized with a fluid 12*a* to create a fracture 14 in the formation 16. The fluid 12*a* contains solid state or encapsulated reactive chemicals 18 (see above). After pumping stops and the fluid 12*a* leaks off into the formation 16, the fracture 14 closes on the solid state materials 18 which react to destabilize the formation 16 (see FIG. 2). The localization of the reactive chemicals in the fracture means that when production starts from the formation 16, rock failure and worm-holing 20*a* are found close to the 'ghost' 22 of the fracture and closely aligned with it (see FIG. 3).

Figure 4:
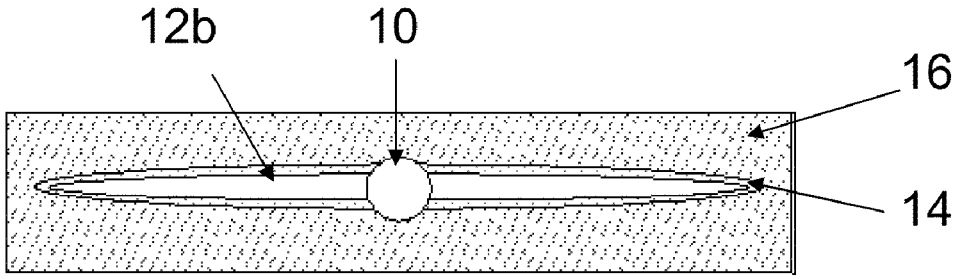
FIGS. 4-6 show a top view of a borehole at various stages of a procedure according to a second embodiment of the invention.
Figure 5:
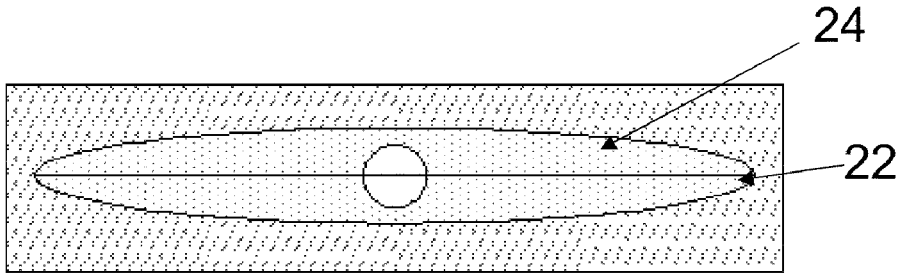
Figure 6:
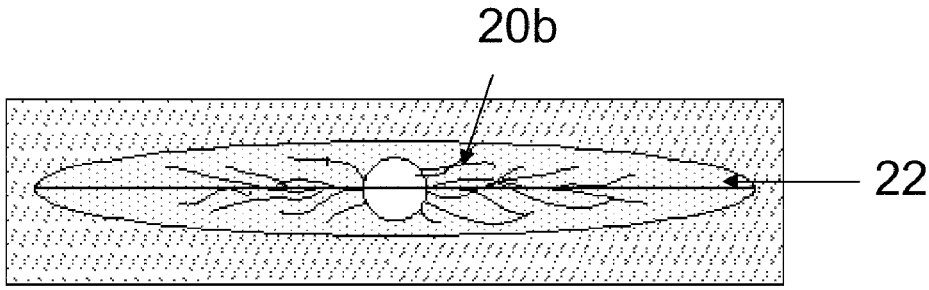

By including a liquid reactive chemical, the wider, leaked off region can be made susceptible to failure as is illustrated in FIGS. 4-6. Initially, the fluid is pumped to create a fracture in essentially the same manner as is described above in relation to FIG. 1 (see FIG. 4). However, when pumping stops, the reactive fluid 12*b* leaks off into the region of formation 24 surrounding the fracture 14 (see FIG. 5). This in turn leads to a wider region of rock failure and worm-holing 20*b* around the 'ghost' 22 of the fracture 14 that is less constrained and aligned (see FIG. 6).

Also, as a means of forcing localized failure in the affected region, the fluid, whether aqueous, hydrocarbon, or solvent based, can be chosen to interact differently with the fluids in the formation. For example, the carrier fluid can be chosen to be a solvent of the heavy oil in the formation. By diluting the heavy oil with a solvent, the fluid in the destabilized region, or adjacent to the destabilized region, has a lower viscosity, and a higher likelihood of been induced to flow more readily than the virgin oil. If an aqueous fluid is chosen with a very high salt concentration (compared with the water cut in the virgin formation), then there could be a localized high fluid pressure due to osmotic forces.

Diversion and viscous fingering techniques can be used to further direct the channels of rock failure.

One method of obtaining feedback from the process, and thereby increasing control, is to include conservative tracers in the fluid, in the solid additives or in both. That way, long term analysis of the produced fluid can help determine the worm holing profile, or help identify how the formation is failing.

Other changes within the scope of the invention will be apparent. For example, periodic pressurization with CO2, shut in, followed by production ("huff 'n puff") can be used with the technique of the invention.

The invention claimed is:

1. A method of stimulating production from a subterranean formation penetrated by a wellbore, the method comprising:

pumping a fluid from the well into the formation so as to create a hydraulic fracture, wherein the fluid contains one or more reactive species that destabilise cohesive forces in the formation matrix; and, allowing the fluid to leak of into the formation and react with the formation matrix so as to produce a destabilised zone in the formation around the location of the fracture such that formation fluids and sand particles can be produced from the formation through the zone and into the well.

2. The method of claim 1, further comprising selecting the fluid so as to produce an at least partially unconsolidated formation matrix in the destabilised zone.

3. The method of claim 1, further comprising producing fluids from the formation so as to cause worm-holing in the destabilised zone.

4. The method of claim 2, further comprising producing fluids from the formation so as to cause worm-holing in the destabilised zone.

5. The method of claim 1, wherein the fluid comprises additives in liquid form.

6. The method of claim 1, wherein the fluid comprises additives in solid or granular form.

7. The method of claim 1, wherein the fluid behaves as a diluent for heavy oil.

8. The method of claim 7, wherein the fluid modifies formation fluid rheology.

9. The method of claim 1, wherein the method comprises alternately pumping the fluid containing the reactive species and a diverting fluid into the formation.

10. The method of claim 1, wherein the method comprises alternately pumping into the formation the fluid containing the reactive species and a fluid that acts to provide local consolidation in the matrix.

11. The method of claim 1, wherein the method comprises periodically injecting $CO_2$ into the formation and shutting in the well to allow the $CO_2$ to dissipate and dissolve followed by production from the formation.

12. The method of claim 1, wherein the fluid comprises chemical tracers.

13. The method of claim 1, wherein the fluid comprises isotopic tracers.

14. The method of claim 1, wherein the fluid comprises radioactive tracers.

15. The method of claim 1, as used in a well producing heavy oil from the formation.

16. A method of stimulating production from a subterranean formation penetrated by a wellbore, the method comprising:

pumping a fluid from the well into the formation, wherein the fluid contains one or more reactive species that destabilise cohesive forces in the formation matrix;

allowing the fluid to leak of into the formation and react with the formation matrix so as to produce a destabilised zone in the formation such that formation fluids and sand particles can be produced from the formation through the zone and into the well; and, periodically injecting $CO_2$ into the formation and shutting in the well to allow the $CO_2$ to dissipate and dissolve followed by production from the formation.

17. The method of claim 16, further comprising selecting the fluid so as to produce an at least partially unconsolidated formation matrix in the destabilised zone.

18. The method of claim 16, wherein the fluid behaves as a diluent for heavy oil.

19. The method of claim 16, wherein the fluid modifies formation fluid rheology.

* * * * *